United States Patent [19]

Ross et al.

[11] Patent Number: 4,795,584

[45] Date of Patent: Jan. 3, 1989

[54] LAUNDRY COMPOSITIONS

[75] Inventors: Anne M. Ross; David F. Kirkwood, both of New Castle upon Tyne, Great Britain

[73] Assignee: The Procter & Gamble Company, Cincinnati, Ohio

[21] Appl. No.: 70,472

[22] Filed: Jul. 7, 1987

[30] Foreign Application Priority Data

Jul. 15, 1986 [GB] United Kingdom ..... 8617255

[51] Int. Cl.[4] ..... C11D 1/62; C11D 1/65; C11D 3/37

[52] U.S. Cl. ..... 252/174.23; 252/547; 252/153; 252/174.24; 252/DIG. 15

[58] Field of Search ..... 252/547, 153, 174.23, 252/174.24, DIG. 2, DIG. 15

[56] References Cited

U.S. PATENT DOCUMENTS

| | | | |
|---|---|---|---|
| 3,712,873 | 1/1973 | Zenk | 524/156 |
| 3,959,230 | 5/1976 | Hays | 528/297 |
| 3,962,152 | 6/1976 | Nicol et al. | 252/551 |
| 4,116,885 | 9/1978 | Derstadt et al. | 252/532 |
| 4,132,680 | 1/1979 | Nicol | 252/547 |
| 4,411,831 | 10/1983 | Robinson et al. | 252/554 |
| 4,548,744 | 10/1985 | Connor | 252/545 |
| 4,571,303 | 2/1986 | Crallella | 252/174.23 |
| 4,713,194 | 12/1987 | Gosselink | 252/174.23 |

FOREIGN PATENT DOCUMENTS

| | | |
|---|---|---|
| 0199403 | 10/1986 | European Pat. Off. . |
| 2137221 | 10/1984 | United Kingdom . |

*Primary Examiner*—Paul Lieberman
*Assistant Examiner*—Ronald A. Krasnow
*Attorney, Agent, or Firm*—Robert B. Aylor; Richard C. Witte

[57] ABSTRACT

A laundry detergent or detergent additive composition comprising from about 0.1% to about 25% by weight of a soil-release polymer comprising ethyleneoxy terephthalate (EO-T) units and polyethyleneoxy terephthalate (PEO-T) units at a molar ratio (EO-T/PEO-T) of from about 0.5 to about 1.5, the PEO-T units containing polyethylene oxide (PEO) linking units having a molecular weight of from about 300 to about 3000, the molecular weight of the polymer being in the range from about 900 to about 9,000, and up to about 20% of a water-soluble quaternary ammonium surfactant.

The composition provides excellent soil-release performance without detriment to clay-soil detergency and anti-deposition performance.

19 Claims, No Drawings

LAUNDRY COMPOSITIONS

TECHNICAL FIELD

The present invention relates to laundry detergent compositions. In particular, it relates to laundry detergent compositions containing soil-release agents.

BACKGROUND OF THE INVENTION

In addition to cleaning, laundry detergent compositions desirably have other benefits. One is the ability to confer soil release properties to fabrics, particularly those woven from polyester fibres. These fabrics are mostly co-polymers of ethylene glycol and terephthalic acid, and are sold under a number of tradenames, e.g. Dacron, Fortrel, Kodel and Blue C Polyester. The hydrophobic character of polyester fabrics makes their laundering difficult, particularly as regards oily soil and oily stains. The oily soil or stain preferentially "wets" the fabric. As a result, the oily soil or stain is difficult to remove in an aqueous laundering process.

High molecular weight (e.g., 40,000 to 50,000 M.W.) polyesters containing random ethylene terephthalate/-polyethylene glycol terephthalate units have been used as soil release compounds in laundry detergent compositions—see for example U.S. Pat. Nos. 3,962,152 and 3,959,230. During the laundering operation, these soil release polyesters adsorb onto the surface of fabrics immersed in the wash solution. The adsorbed polyester then forms a hydrophilic film which remains on the fabric after it is removed from the wash solution and dried. This film can be renewed by subsequent washing of the fabric with a detergent composition containing the soil release polyesters.

A major disadvantage of the known detergent formulations, however, is that they can adversely effect cleaning performance in other areas of laundry detergency, especially clay soil detergency. Presumably this is the result of the polymer depositing on soil which is already adhered to the fabric surface, thereby preventing solubilization or dispersion of the soil by other components of the detergent composition.

It is also known that introducing specific quaternary ammonium surfactants into the aqueous laundry liquor can provide increased deposition of terephthalate-based soil-release polymers and hence provide superior removal of oily soils and stains (see U.S. Pat. No. 4132680).

Quaternary ammonium surfactants are themselves known to have a detrimental effect on clay soil detergency and anti-redepositon and, if anything, therefore adding a quaternary ammonium surfactant merely compounds the problem.

It has now been discovered that certain terephthalate soil release polymers having a specified ratio of ethyleneoxy terephthalate to polyethyleneoxy terephthalate units and specified molecular weight and preferably having polyethyleneglycol terminating groups at both ends of the polymer chain provide excellent soil-release performance in a detergency context without detriment to clay soil detergency and anti-redeposition. Indeed in a low or zero phosphate detergent compositions, clay soil cleaning performance is actually enhanced. Furthermore, incorporation of a water-soluble quaternary ammonium surfactant promotes further increases in polymer deposition and improved soil-release performance again surprisingly without detriment to clay-soil detergency. Moreover, the quaternary ammonium surfactant is beneficial from the viewpoint of promoting soil-release performance in the presence of anionic surfactant components.

SUMMARY OF THE INVENTION

According to one aspect of the invention, therefore, there is provided a laundry detergent or detergent additive composition comprising (a) from about 0.1% to about 25% by weight of a soil-release polymer comprising ethyleneoxy terephthalate (EO-T) units and polyethyleneoxy terephthalate (PEO-T) units at a molar ratio (EO-T/PEO-T) of from about 0.5 to about 1.5, the PEO-T units containing polyethylene oxide (PEO) linking units having a molecular weight of from about 300 to about 3000, the molecular weight of the polymer being in the range from about 900 to about 9,000, and (b) from about 0.1% to about 20% of a water-soluble quaternary ammonium surfactant.

The compositions of the invention contain from about 0.1% to about 25% preferably from about 0.2% to about 15%, more preferably from about 0.3% to about 10%, of a soil release polymer containing ethyleneoxy terephthalate (EO-T) groups having the formula:

$$[-OCH_2CH_2O\overset{O}{\overset{\|}{C}}C_6H_4\overset{O}{\overset{\|}{C}}-]; \text{ and}$$

polyethyleneoxy terephthalate (PEO-T) groups having the formula:

$$[-(OCH_2CH_2)_nO\overset{O}{\overset{\|}{C}}C_6H_4\overset{O}{\overset{\|}{C}}-]$$

wherein the molar ratio of ethyleneoxy terephthalate to polyethyleneoxy terephthalate in the polymer is from about 0.5 to about 1.5. The molecular weight of the polyethylene oxide linking unit is in the range from about 300 to about 3,000 i.e., n in the above formula is an integer of from about 7 to about 70. The polymers have an average molecular weight in the range from 900 to about 9,000. The polymers are also characterized by a random polymer structure, i.e., all possible combinations of ethyleneoxy terephthalate and polyethyleneoxy terephthalate can be present.

Highly preferred from the viewpoint of acceptable clay-soil detergency are soil-release polymers comprising at least about 10%, preferably at least 20% thereof (molar basis) of components wherein both chain terminating units of the polymer are independently selected from units having the general formula X-PEO-T wherein X is selected from H, $C_{1-4}$ alkyl, $C_{1-4}$ hydroxyalkyl and $C_{1-4}$ acyl.

Also preferred herein from the viewpoint of achieving optimum soil-release and clay-soil cleaning performance are soil release polymers having a molecular weight in the range from about 1,000 to about 4,900, preferably from about 1,500 to about 4,500, and an EO-T/PEO-T molar ratio of from about 0.6 to about 0.95, preferably from about 0.65 to about 0.85. The PEO molecular weight on the other hand, is preferably from about 1,000 to about 2,000, more preferably from about 1,200 to about 1,800.

The molar ratio of EO-T to PEO:T units is determined herein by 270 MHz proton NMR, the ratio being directly derived from the relative peak areas of the $C_6H_4CO_2CH_2$ methylene resonances attributable to EO-T and PEO-T groups respectively. Molecular weight, on the other hand, is determined herein by measuring the specific viscosity of a solution of the polymer in chloroform at 0.5 g/dl concentration using an Ostwald No 100 viscometer, the number average molecular weight (M) being related to the specific viscosity ($N_{sp}$) and concentration (c) by the equation $$M=3.6236\times10^4(N_{sp/c})^{1.3852}$$

The compositions of the invention preferably also contain from about 0.1% to about 20%, more preferably from about 0.5% to about 15%, especially from about 1% to about 5% of a water-soluble quaternary ammonium surfactant. Preferred for use herein are quaternary ammonium surfactants having the general formula:

$$[R^2(OR^3)_y][R^4(OR^3)_y]_2R^5N^+X^-$$

wherein $R^2$ is an alkyl, alkenyl or alkyl benzyl group having from about 8 to about 18 carbon atoms, preferably 10 to 14 carbon atoms in the alkyl chain; each $R^3$ is selected from $—CH_2CH_2—$, $—CH_2CH(CH_3)—$, $—CH_2CH_2CH_2—$, and mixtures thereof; each $R^4$ is selected from $C_1$–$C_4$ alkyl, $C_1$–$C_4$ hydroxyalkyl, benzyl, ring structures formed by joining the two $R^4$ groups, $—CH_2CHOHCHOHCOR^6CHOHCH_2OH$ wherein $R^6$ is any hexose or hexose polymer having a molecular weight less than about 1,000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate alkyl trimethylammonium salts, alkyl di(hydroxyethyl)methylammonium salts, alkyl hydroxyethyldimethylammonium salts, and alkyloxypropyl trimethylammonium salts, wherein alkyl is $C_8$–$C_{16}$, preferably $C_{10}$–$C_{14}$. Of the above, decyl trimethylammonium methulsulfate, lauryl trimethylammonium chloride, myristyl trimethylammonium bromide and coconut trimethylammonium chloride and methylsulfate are particularly preferred.

Other useful cationic surfactants are disclosed in U.S. Pat. No. 4,259,217.

Highly preferred water-soluble cationic surfactants herein have a critical micelle concentration (CMC) as measured for instance by surface tension or conductivity of at least 200 ppm, preferably at least 500 ppm at 30° C. and in distilled water—see for instance Critical Micelle Concentrations of Aqueous Surfactant Systems, P. Mukerjee and K J Mysels NSRDS-NBS 36, (1971).

The compositions of the invention can take the form of a conventional main wash laundry detergent composition of a laundry additive composition for use together with a separate main-wash detergent composition. In either instance, however, preferred compositions will normally contain from about 1% to about 40%, more preferably from about 5% to about 25% by weight of anionic or nonionic surfactant. The compositions can also be complemented by other usual laundry detergent components such as detergency builders, bleaches etc.

Suitable synthetic anionic surfactants are water-soluble salts of $C_8$–$C_{22}$ alkyl benzene sulphonates, $C_8$–$C_{22}$ alkyl sulphates, $C_{10-18}$ alkyl, polyethoxy ether sulphates, $C_{8-24}$ paraffin sulphonates, alpha- $C_{12-24}$ olefin sulphonates, alpha-sulphonated $C_6$–$C_{20}$ fatty acids and their esters, $C_{10}$–$C_{18}$ alkyl glyceryl ether sulphonates, fatty acid monoglyceride sulphates and sulphonates, especially those prepared from coconut oil, $C_8$–$C_{12}$ alkyl phenol polyethoxy ether sulphates, 2-acyloxy $C_9$–$C_{23}$ alkane-1-sulphonate, and beta-alkyloxy $C_8$–$C_{20}$ alkane sulphonates.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups).

Examples of this group of synthetic detergents are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. No. 2,220,099 and U.S. Pat. No. 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred.

Suitable fatty acid soaps herein can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Fatty acids in partially neutralized form are also suitable for use herein, especially in liquid compositions. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulphonate and sulphate surfactants in a weight ratio of from about 5:1 to about 1:5, preferably from about 5:1 to about 1:1, more preferably from about 5:1 to about 1.5:1. Especially preferred is a mixture of an alkyl benzene sulphonate having from 9 to 15, especially 11 to 13 carbon atoms in the alkyl radical, the cation being an alkali metal, preferably sodium; and either an alkyl sulphate having from 10 to 20, preferably 12 to 18 carbon atoms in the alkyl radical or an ethoxy sulphate having from 10 to 20, preferably 10 to 16 carbon atoms in the alkyl radical and an average degree of ethoxylation of 1 to 6, having an alkali metal cation, preferably sodium.

Nonionic surfactants suitable herein are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5.

Examples of suitable nonionic surfactants include the condensation products of primary or secondary aliphatic alcohols having from 8 to 24 carbon atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alchols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

Other suitable nonionic surfactants include the condensation products of $C_6$–$C_{12}$ alkyl phenols with from about 3 to 30, preferably 5 to 14 moles of ethylene oxide, and with the compounds formed by condensing ethylene oxide with a hydrophobic base formed by the condensation of propylene oxide with propylene glycol, such synthetic nonionic detergents being available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Suitable builder salts useful in the compositions of the invention can be of the polyvalent inorganic and polyvalent organic types, or mixtures thereof. The level of these materials is generally from about 15% to about 90%, preferably from about 20% to about 60% to weight of the total laundry composition. Non-limiting examples of suitable water-soluble, inorganic alkaline builder salts include the alkali metal carbonates, borates, phosphates, pyrophosphates, tripolyphosphates and bicarbonates.

Organic builder/chelating agents that can be incorporated include organic polycarboxylates and aminopolycarboxylates and their salts, organic phosphonate derivatives such as those disclosed in U.S. Pat. Nos. 3,213,030, 3,433,021, 3,292,121 and 2,599,807, and carboxylic acid builder salts such as those disclosed in U.S. Pat. No. 3,308,067.

Preferred chelating agents include citric acid, nitrilotriacetic (NTA) and ethylenediamine tetra acetic acids (EDTA), hydroxyethylethylenediaminetriacetic acid (HEEDTA), nitrilo(trimethylene phosphonic acid) (NTMP), ethylenediamine tetra(methylene phosphonic acid) (EDTMP) and diethylenetriamine penta(methylene phosphonic acid) (DETPMP) and salts thereof. Mixtures of organic and/or inorganic builders can be used herein. One such mixture of builders is disclosed in No. CA-A-755,038, e.g. a ternary mixture of sodium tripolyphosphate, trisodium nitrilotriacetate, and trisodium ethane-1-hydroxy-1,1-diphosphonate.

As mentioned earlier, a valuable feature of the invention is the improved clay-soil detergency performance observed in compositions having a low or zero phosphate builder content. Accordingly, preferred compositions herein have a phosphorus content of less than about 5%, preferably less than about 2% by weight. In composition of this type, the builder preferably belongs to the alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of No. GB-A-1,429,143, No. DE-A-2,433,485, and No. DE-A-2,525,778.

The laundry compositions herein can be supplemented by all manner of detergent and laundering components.

An alkali metal, or alkaline earth metal, silicate can also be present. The alkali metal silicate is preferably from about 3% to about 15% by weight of the total composition. Suitable silicate solids have a molar ratio of $SiO_2$/alkali metal$_2$O in the range from about 0.5 to about 3.3, more preferably from about 1.0 to about 2.0.

The laundry compositions herein can also contain bleaching components. In general, the bleach is selected from inorganic peroxy salts, hydrogen peroxide, hydrogen peroxide adducts, and organic peroxy acids and salts thereof. Suitable inorganic peroxygen bleaches include sodium perborate mono- and tetrahydrate, sodium percarbonate, sodium persilicate, urea-hydrogen peroxide addition products and the clathrate $4Na_2So_4$:2-$H_2O_2$:1NaCl. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid and salts (especially the magnesium salts) thereof. The bleaching agent is generally present at a level of from about 5% to about 35%, preferably from about 10% to about 25% by weight of total laundry composition. Peroxyacid bleach precursors suitable herein are disclosed in No. UK-A-2040983, highly preferred being peracetic acid bleach precursors such as tetraacetylethylene diamine, tetraacetylmethylenediamine, tetraacetyl-hexylenediamine, sodium p-acetoxybenzene sulphonate, tetraacetylglycouril, pentaacetylglucose, octaacetyllactose, methyl O-acetoxy benzoate, sodium 3,5,5-trimethylhexanoyloxybenzene sulfonate, sodium 3,5,5-trimethylhexanoyloxybenzoate, sodium 2-ethylhexanoyloxybenzenesulfonate, sodium nonanoyloxybenzenesulfonate and sodium octanoyloxybenzenesulfonate. In laundry detergent compositions, the level of bleach precursor is generally from about 0.5% to about 10%, preferably from about 1% to about 6% by weight of the total composition. In additive compositions, however, the bleach precursor is preferably added in a level of from about 1% to about 50%, preferably from about 5% to about 35% by weight thereof.

Other optional components of the compositions herein include suds suppressors, enzymes, fluorescers, photoactivators, soil suspending agents, anti-caking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weight in the range from about 200 to about 200,000 and a kinematic viscosity in the range from about 20 to about 2,000,000 $mm^2/s$, preferaby from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 4000–1000, and a penetration value of at least 6, measured at 77° C. by ASTM-D1321, and also paraffin waxes, synthetic waxes and natural waxes. Suitable phosphate esters include mono- and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. No. 3,519,570 and U.S. Pat. No. 3,533,139. Suitable fluorescers include Blankophor MBBH (Bayer AG) and Tinopal CBS-X and EMS (Ciba Geigy). Photoactivators are discussed in No. EP-A-57088, highly preferred materials being zinc phthalocyanine, tri and tetra-sulfonates. Suitable fabric conditioning agents include smectite-type clays are disclosed in No. GB-A-1400898 and di-$C_{12}$–$C_{24}$ alkyl or alkenyl amines and ammonium salts.

Antiredeposition and soil suspension agents suitable herein include cellulose derivatives such as methylcellulose, carboxymethylcellulose and hydroxyethylcellulose, and homo- or co-polymeric polycarboxylic acids or their salts in which the polycarboxylic acid comprises at least two carboxyl radicals separated from each other by not more than two carbon atoms. Polymers of this type are disclosed in No. GB-A-1,596,756. Preferred polymers include copolymers or salts thereof of maleic anhydride with ethylene, methylvinyl ether, acrylic acid or methacrylic acid, the maleic anhydride constituting at least about 10 mole percent, preferably at least about 20 mole percent of the copolymer. These polymers are valuable for improving whitness maintenance, fabric ash deposition, and cleaning performance on clay, proteinaceous and oxidizable soils in the presence of transition metal impurities.

The laundry detergent and additive compositions of the invention can be formulated, packaged and retailed in conventional granular, powdery or liquid form but preferably, the composition is formulated as part of a laundry product comprising the composition in water-releasable combination with a water-insoluble substrate or a single- or multi-compartment sachet. Laundry products of this kind are valuable herein from the viewpoint of providing a slow and sustained release of the soil-removal polymer into the laundry solution, a factor which appears to be beneficial for achieving optimum soil-release and single-cycle cleaning advantages.

Laundry products preferred for use herein comprise a substrate or sachet formed from a flexible, water-insoluble sheet-like material. The sheet-like material may be made of paper, woven or non-woven fabrics or the like.

The basis weight of the water-insoluble sheet is preferably from about 10 to about 70 grams/sq meter, more preferably from about 20 to about 50 grams/sq meter. Preferred materials for use herein are apertured nonwoven fabrics which can generally be defined as adhesively or thermo-bonded fibrous or filamentous products, having a web or carded fibre structure (where the fibre strength is suitable to allow carding) or comprising fibrous mats, in which the fibres of filaments are distributed haphazardly or in random array (i.e. an array of fibres in a carded web wherein partial orientation of the fibres is frequently present as well as a completely haphazard distributional orientation) or substantially aligned. The fibres or filaments can be natural (e.g. wool, silk, wood pulp, jute, hemp, cotton, linen, sisal, or ramie), synthetic (e.g. rayon, cellulose, ester, polyvinyl derivatives, polyolefins, polyamides, or polyesters) or mixtures of any of the above.

Generally, non-woven cloths can be made by air or water laying processes in which the fibres or filaments are first cut to desired lengths from long strands, passed into a water or air stream, and then deposited onto a screen through which the fibre-laden air or water is passed. The deposited fibres or filaments are then adhesively or thermo-bonded together, dried cured and otherwise treated as desired to form the non-woven cloth. Non-woven cloths which are spin-bonded, spin-laced or melt-blown are also suitable however.

Preferably, the non-woven cloth is made from cellulosic fibres, particularly from regenerated cellulose or rayon, which are lubricated with standard textile lubricant such as sodium oleate. The non-woven cloth preferably also has a content of a polyolefin such as polypropylene to allow for heat sealing to the poly(ethylene oxide) film. Preferably the fibres are from about 4 to about 50 mm, especially from about 8 mm to about 20 mm, in length and are from about 1 to about 5 denier (denier is an internationally recognised unit in yarn measure, corresponding to the weight in grams of a 9,000 meter length of yarn).

Preferably the fibres are at least partially orientated haphazardly, particularly substantially haphazardly, and are adhesively bonded together with hydrophobic or substantially hydrophobic binder-resin, particularly with a nonionic self-crosslinking acrylic polymer or polymers. In highly preferred embodiments, the cloth comprises from about 75% to about 88%, especially from about 78% to about 84% fibre and from about 12% to about 25%, especially from about 16% to about 22% hydrophobic binder-resin polymer by weight and has a basis weight of from about 10 to about 70, preferably from 20 to 50 g/m$^2$. Suitable hydrophobic binder-resins are ethylacrylate resins such as Primal HA24, Rhoplex HA8 and HA16 (Rohm and Haas, Inc) and mixtures thereof.

The substrate apertures, which extend between opposite surfaces of the substrate, are normally in a pattern and are formed during lay-down of the fibres to produce the substrate. Exemplary apertured non-woven substrates are disclosed in U.S. Pat. Nos. 3,741,724, 3,930,086 and 3,750,237.

An example of an apertured non-woven substrate suitable herein is a polypropylene-containing regenerated cellulose sheet of 1.5 denier fibres bonded with Rhoplex HA 8 binder (fibre:binder ratio of about 77:23) having a basis weight of about 35 g/m$^2$ and about 17 apertures/cm$^2$. The apertures are generally ellipitical in shape and are in side-by-side arrangement. The apertures have a width of about 0.9 mm and a length of about 2.5 mm measured in a relaxed condition. Another highly preferred substrate based on 1.5 denier regenerated cellulose fibres with Rhoplex HA8 binder has a fibre:binder ration of about 82:18, a basic weight of about 35 g/m$^2$, and about 22 apertures/cm$^2$. In this example, the apertures are generally square-shaped with a width of about 1.1 mm. The apertures are again disposed in side-by-side arrangement.

In the substrate embodiments of the invention, the laundry composition is coated on or impregnated into the substrate at a weight ratio of composition:substrate of at least about 3:1, preferably at least about 5:1. In these embodiments, the laundry composition preferably contains at least about 5%, more preferably at least about 15% by weight of composition of water-soluble or water-dispersible organic binding agent. Preferably, the binding agent is selected from polyethylene glycols of molecualr weight greater than about 1,000, more preferably greater than about 4,000, $C_{12}$–$C_{18}$ fatty acids and esters and amides thereof, polyvinyl pyrrolidone of molecular weight in the range from about 40,000 to about 700,000, and $C_{14}$–$C_{24}$ fatty alcohols ethoxylated with from about 14 to about 100 moles of ethylene oxide.

The laundry compositions of the invention in granular or powder form are preferably made by spray-drying an aqueous slurry comprising anionic surfactant and detergency builder to a density of at least about 0.3 g/cc, spraying-on nonionic surfactant, where present, and optionally comminuting the spray-dried granules in for example a Patterson-Kelley twin shell blender to a bulk density of at least about 0.5 g/cc. The aqueous slurry for spray drying preferably comprises from about 30% to about 60% water and from about 40% to about 70% of the detergency builder; it is heated to a temperature of from about 60° C. to about 90° C. and spray dried in a current of air having an inlet temperature of from about 200° C. to about 400° C., preferably from about 275° C. to about 350° C., and an outlet temperature of from about 95° C. to about 125° C., preferably from about 100° C. to about 115° C. The weight average particle size of the spray dried granules is from about 0.15 to about 3 mm, preferably from about 0.5 mm to about 1.4 mm. After comminution, the weight average particle size is from about 0.1 to about 0.5 mm, preferably from about 0.15 to about 0.4 mm.

In the Examples, the abbreviations used have the following designation:

| | |
|---|---|
| LAS | Linear $C_{12}$ alkyl benzene sulphonate |
| TAS | Tallow alkyl sulphate |
| $C_{14/15}$AS | Sodium $C_{14}$–$C_{15}$ alkyl sulphate |
| TAE$_n$ | Hardened tallow alcohol ethoxylated with n moles of ethylene oxide per mole of alcohol |
| $C_{14}$TMAB | $C_{14}$ alkyl trimethyl ammonium bromide |
| Dobanol 45-E-7 | A $C_{14}$–$C_{15}$ primary alcohol condensed with 7 moles of ethylene oxide, marketed by Shell |
| Clay | Sodium montmorillonite |
| INOBS | Sodium 3,5,5-trimethyl hexanoyl oxybenzene sulphonate |
| TAED | Tetraacetylethylenediamine |
| Silicone/Silica | 85:15 mixture of polydimethylsiloxane and silanated silica prilled with STPP and TAE$_{80}$ |
| Enzyme | Savinase prills |
| STPP | Sodium tripolyphosphate |
| Zeolite | Zeolite 4A |
| Polymer | Terephthalate Soil release polymer; EO-T/PEO:T = 0.6; Molecular weight = 3,800 |
| Gantrez AN119 | Moleic anhydride/vinyl methyl ether copolymer mol. wt about 240,000 |
| Metasilicate | Sodium metasilicate |
| $Na_2CO_3$ | Sodium carbonate |
| Silicate | Sodium silicate ($SiO_2$:$Na_2O$ = 1.6:1) |
| Perborate | Anhydrous sodium perborate bleach of empirical formula $NaBO_2.H_2O_2$ |
| Percarbonate | Sodium percarbonate |
| MA/AA | Maleic acid/acrylic acid copolymer, 1:3 mole ratio, m.wt. 70,000 |
| EDTA | Sodiumethylenediaminetetraacetate |
| Brightener | Tinopal (RTM) CBS-X |
| EDTMP | Ethylenediamine tetra(methylene phosphonic acid), marketed by Monsanto, under the Trade name Dequest 2041 |
| Substrate | Non-woven fabric formed of 100% unbleached crimped rayon fibres of 1:5 denier bonded with 18% polyacrylate binder; basis weight 35 g/m$^2$; 22 square-shaped apertures/cm$^2$; side dimension 1.1 mm |

EXAMPLES 1 TO 6

Laundry additive products according to the invention are prepared as follows. For each product, the components of the laundry additive composition are mixed at a temperature of about 65° C. and passed through a Fryma Colloid Mill, Model MK95-R/MZ 80R (made by M.M. Process Equipment Ltd of M.M. House, Frogmore Road, Hemel Hempstead, Hertfordshire, United Kingdom) in which the grinding faces are set to a separation of about 180 microns. The melt is then fed through a pair of counterrotating rolls heated to 76° C. and having a nip setting of 250 microns and is transferred to substrate moving counter to one of the rollers by wiping. The coated substrate is finally passed between a pair of static plates having a spacing of 180 microns, air-cooled, and cut into sheets of size 35×23 cm.

| | EXAMPLES | | | | | |
|---|---|---|---|---|---|---|
| | 1 | 2 | 3 | 4 | 5 | 6 |
| LAS | — | 3 | — | — | 5 | — |
| $C_{12/14}$AS | 5 | 3 | 6 | — | 3 | 8 |
| TAE$_{25}$ | — | 3 | — | — | — | 4 |

-continued

| | EXAMPLES | | | | | |
|---|---|---|---|---|---|---|
| | 1 | 2 | 3 | 4 | 5 | 6 |
| $C_{14}$TMAB | 2 | 3 | 4 | 2 | 1 | 3 |
| Dobanol 45-E-7 | 5 | 3 | 5 | 5 | 5 | — |
| PEG 8000 | 5 | 5 | 7 | 4 | 7 | 8 |
| TAED | 5 | — | — | 5 | — | — |
| INOBS | — | 3 | — | — | 3 | — |
| Silicone/Silica | 0.3 | 0.2 | 0.2 | 0.2 | 0.3 | 0.3 |
| Gantrez AN119 | 0.3 | — | — | 0.5 | — | 0.5 |
| Perborate | — | — | 5 | — | — | — |
| EDTA | — | — | — | — | — | — |
| Polymer | 1 | 0.5 | 2 | 1 | 2 | 1.5 |
| Brightener | — | 0.3 | 0.1 | 0.1 | 0.2 | 0.1 |
| EDTMP | — | — | 1.5 | 0.5 | — | — |
| Moisture | 0.8 | 0.5 | 0.6 | 0.2 | 0.5 | 0.7 |
| Substrate | 2.6 | 2.6 | 2.6 | 2.6 | 2.6 | 2.6 |

When used as laundry additive products together with a main wash laundry detergent composition, the above products provide excellent soil release performance without detriment to clay-soil detergency and anti-redeposition performance

EXAMPLES VII TO XII

Six laundry products are prepared as follows:

A base powder composition is first prepared by mixing all components except Dobanol 45E7, bleach, bleach activator, enzyme, suds supressor, phosphate and carbonate in a crutcher as an aqueous slurry at a temperature of about 55° C. and containing about 35% water. The slurry is then spray dried at a gas inlet temperature of about 330° C. to form base powder granules and the granules are comminuted in a Patterson-Kelley twin shell blender. The bleach activator where present, is then admixed with $TAE_{25}$ as binder and extruded in the form of elongate particles through a radial extruder as described in European patent application No. 62523. The bleach activator noddles, bleach, enzyme, suds suppressor, phosphate and carbonate are then dry-mixed with the base powder composition and finally Dobanol 45E7 is sprayed into the final mixture. Each composition had a bulk density of about 0.7 g/cc.

| | VII | VIII | IX | X | XI | XII |
|---|---|---|---|---|---|---|
| LAS | 5 | 8 | 8 | 3 | 4 | 9 |
| TAS | — | — | 3 | — | 4 | 3 |
| $C_{14/15}$AS | 5 | 8 | — | 1 | — | — |
| $TAE_{25}$ | 0.5 | 0.3 | 0.5 | 0.2 | 0.8 | 0.5 |
| $C_{14}$TMAB | 2 | 3 | 1 | 1 | 2 | 4 |
| Dobanol 45-E-7 | 2 | 2 | 4 | 10 | 4 | — |
| Clay | — | 6 | — | — | 4 | 7 |
| INOBS | — | 2 | 4 | — | — | 3 |
| TAED | 3 | — | 0.5 | — | 2 | — |
| Polymer | 2 | 3 | 1 | 4 | 2 | 1 |
| Silicone/Silica | 0.2 | 0.2 | 0.4 | 0.8 | 0.4 | 0.5 |
| Enzyme | 0.5 | 0.6 | 0.7 | 0.8 | 0.5 | 0.6 |
| STPP | 6 | — | 18 | — | 2 | 4 |
| Zeolite | 12 | 18 | 6 | 22 | 20 | 18 |
| Metasilicate | — | — | — | — | — | 5 |
| $Na_2CO_3$ | 5 | — | 8 | — | — | 5 |
| Silicate | 5 | 6 | 10 | 6 | 6 | — |
| Perborate | 10 | — | 14 | — | — | 12 |
| Percarbonate | — | — | — | — | 20 | — |
| MA/AA | 4 | 3 | 2 | 2 | 4 | 2 |
| EDTA | 0.5 | 0.5 | 0.5 | 0.5 | 0.5 | 0.5 |
| Brightener | 0.2 | 0.2 | 0.2 | 0.2 | 0.2 | 0.2 |
| EDTMP | 0.2 | 0.1 | 0.2 | 0.3 | 0.2 | 0.1 |
| Sulphate, moisture | | | To 100 | | | |

A twin-component sachet is made from a non-woven fabric formed of 100% unbleached crimped rayon fibres of 1.5 denier bonded with 18% polyacrylate builder, the non-woven fabric having a basis weight of 35 g/m$^2$. The sachet is made from a sheet of the fabric measuring 120 mm×80 mm by folding midway along the long dimension, sealing along the top opposing free edges with sodium silicate solution and along a longitudinal seam parallel to and half-way between the two opposing edges, filling the two compartments with 120 cc each of detergent composition VII and then sealing along the open edge of the sachet. The procedure is then replicated five times using composition VIII to XII respectively.

When used as main-wash laundry detergent products, the above examples provide excellent soil-release performance without detriment to clay-soil detergency and anti-redeposition performance.

What is claimed is:

1. A laundry detergent composition comprising:
   (a) from about 0.1% to about 25% by weight of soil-release polymer comprising ethyleneoxy terephthalate (EO-T) units and polyethyeneoxy terephthalate (PEO-T) units at a molar ratio (EO-T/PEO-T) of from about 0.5 to about 1.5, the PEO-T units containing polyethylene oxide (PEO) linking units having a molecular weight of from about 300 to about 3000, the molecular weight of the polymer being in the range from about 900 to about 9,000;
   (b) from about 0.1% to about 20% of water-soluble quaternary ammonium surfactant;
   (c) from about 1% to about 40% of detergent surfactant selected from the group consisting of anionic and nonionic surfactants; and
   (d) from about 15% to about 90% of detergent builder salt selected from the group consisting of polyvalent inorganic builder salts, polyvalent organic builder salts, and mixtures thereof.

2. A composition according to claim 1 wherein the soil-release polymer comprises at least 10% thereof (molar basis) of components wherein both chain terminating units of the polymer are independently selected from units having the general formula X-PEO-T wherein X is selected from H, $C_{1-4}$ alkyl, $C_{1-4}$ hydroxylalkyl and $C_{1-4}$ acyl.

3. A composition according to claim 2 wherein the soil-release polymer comprised at least 20% thereof (molar basis) of components wherein both chain terminating units of the polymer are independently selected from units having the general formula X-PEO-T wherein X is selected from H, $C_{1-4}$ alkyl, $C_{1-4}$ hydroxyalkyl and $C_{1-4}$ acyl.

4. A composition according to claim 3 wherein the soil release polymer has a molecular weight in the range from about 1000 to about 4900.

5. A composition according to claim 4 wherein the soil release polymer has a molecular weight in the range from about 1500 to about 4500.

6. A composition according to claim 4 wherein the soil-release polymer has an EO-T/PEO-T molar ratio of from about 0.6 to about 0.95, and a PEO molecular weight of from about 1000 to about 2000.

7. A composition according to claims 6 wherein the soil-release polymer has an EO-T/PEO-T molar ratio of from about 0.65 to about 0.85, and a PEO molecular weight of from about 1200 to about 1800.

8. A composition according to claim 1 wherein the water-soluble quaternary ammonium surfactant has the general formula:

$$[R^2(OR^3)_y][R^4(OR^3)_y]_2R^5N^+X^-$$

wherein $R^2$ is selected from alkyl, alkenyl and alkyl benzyl group having from about 8 to about 18 carbon atoms in the alkyl chain; each $R^3$ is selected from $—CH_2CH_2—$, $—CH_2CH(CH_3)—$, $—CH_2CH(CH_2OH)—$, $—CH_2CH_2CH_2—$, and mixtures thereof; each $R^4$ is selected from $C_1$–$C_4$ alkyl, $C_1$–$C_4$ hydroxyalkyl, benzyl, ring structures formed by joining the two $R^4$ groups, $—CH_2CHOHCHOHCOR^6CHOHCH_2OH$ wherein $R^6$ is any hexose of hexose polymer having a molecular weight less than about 1000, and hydrogen when y is not 0; Ris the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

9. A composition according to claim 8 wherein $R^2$ is selected from alkyl, alkenyl and alkyl benzyl groups having from 10 to 14 carbon atoms in the alkyl chain.

10. A composition according to claim 1 having a phosphorus content of less than about 2%.

11. A composition according to claim 10 comprising from about 5% to about 50% of a water-insoluble aluminosilicate ion-exchange material.

12. A laundry product comprising a laundry detergent composition according to claim 1 in water-releasable combination with a water-insoluble substrate or a single- or multi-compartment sachet.

13. A detergent additive composition comprising:

(a) from about 0.1% to about 25% by weight of soil-release polymer comprising ethyleneoxy terephthalate (EO-T) units and polyethyleneoxy terephthalate (PEO-T) units at a molar ratio (EO-T/PEO-T) of from about 0.5 to about 1.5, the PEO-T units containing polyethylene oxide (PEO) linking units having a molecular weight of from about 300 to about 3000, the molecular weight of the polymer being in the range from about 900 to about 9,000; and (b) from about 0.1% to about 20% of water-soluble quaternary ammonium surfactant, said detergent additive composition being in conventional granule or powder form.

14. A composition according to claim 13 wherein the soil-release polymer comprises at least 10% thereof on a molar basis of components wherein both chain terminating units of the polymer are independently selected from units the general formula X-PEO-T wherein X is selected from H, $C_{1-4}$ alkyl, $C_{1-4}$ hydroxylalkyl and $C_{1-4}$ acyl.

15. A composition according to claim 14 wherein the soil-release polymer has a molecular weight in the range of from about 1000 to about 4900.

16. A composition according to claim 15 wherein the soil-release polymer has an EO-T/PEO-T molar ratio from about 0.6 to about 0.95, and a PEO molecular weight of from about 1000 to about 2000.

17. A composition according to claim 16 wherein the water-soluble quaternary ammonium surfactant has the general formula:

$$[R^2(OR^3)_y][R^4(OR^3)_y]_2R^5N^+X^-$$

wherein $R^2$ is selected from alkyl, alkenyl and alkyl benzyl group having from about 8 to about 18 carton atoms in the alkyl chain; each $R^3$ is selected from $—CH_2CH_2—$, $—CH_2CH(CH_3)—$, $—CH_2CH(CH_2OH)—$, $—CH_2CH_2CH_2—$, and mixtures thereof; each $R^4$ is selected from $C_1$–$C_4$ alkyl, $C_1$–$C_4$ hydroxyalkyl, benzyl, ring structures formed by joining the two $R^4$ groups, $—CH_2CHOHCHOHCOR^6CHOHCH_2OH$ where $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

18. A composition according to claim 17 wherein $R^2$ is selected from alkyl, alkenyl and alkyl benzyl groups having from 10 to 14 carbon atoms in the alkyl chain.

19. A detergent additive composition comprising a detergent additive composition according to claim 13 in water-releasable combination with a water-insoluble substrate or a single- or multi-compartment sachet.

* * * * *

UNITED STATES PATENT AND TRADEMARK OFFICE

CERTIFICATE OF CORRECTION

PATENT NO. : 4,795,584

DATED : January 3, 1989

INVENTOR(S) : Anne M. Ross and David F. Kirkwood

It is certified that error appears in the above-identified patent and that said Letters Patent is hereby corrected as shown below:

Col. 3, line 26, before "$CH_2CH_2CH_2$-" insert -- -$CH_2CH(CH_2OH)$-, --.

Col. 3, line 63, before "of" insert -- or --.

Signed and Sealed this

Fifth Day of December, 1989

*Attest:*

JEFFREY M. SAMUELS

*Attesting Officer* *Acting Commissioner of Patents and Trademarks*